US007823507B2

(12) United States Patent
Inoue et al.

(10) Patent No.: US 7,823,507 B2
(45) Date of Patent: Nov. 2, 2010

(54) PRINTING DIE CLAMP

(75) Inventors: Hirohisa Inoue, Sanda (JP); Yukihiro Noto, Sanda (JP)

(73) Assignee: Rengo Co., Ltd., Osaka (JP)

( * ) Notice: Subject to any disclaimer, the term of this patent is extended or adjusted under 35 U.S.C. 154(b) by 537 days.

(21) Appl. No.: 11/922,472

(22) PCT Filed: Apr. 27, 2006

(86) PCT No.: PCT/JP2006/308834

§ 371 (c)(1),
(2), (4) Date: Dec. 19, 2007

(87) PCT Pub. No.: WO2006/137218

PCT Pub. Date: Dec. 28, 2006

(65) Prior Publication Data

US 2009/0107350 A1 Apr. 30, 2009

(30) Foreign Application Priority Data

Jun. 23, 2005 (JP) ..... 2005-182903

(51) Int. Cl.
*B41F 21/00* (2006.01)

(52) U.S. Cl. ..... 101/415.1; 101/378

(58) Field of Classification Search ..... 101/378, 101/382.1, 408, 409, 410, 415.1, 477
See application file for complete search history.

(56) References Cited

U.S. PATENT DOCUMENTS 5,052,299 A * 10/1991 Kojima ..... 101/415.1

(Continued)

FOREIGN PATENT DOCUMENTS

JP 62-3730 1/1987

(Continued)

OTHER PUBLICATIONS

International Search Report issued Jul. 18, 2006 in the International (PCT) Application of which the present application is the U.S. National Stage.

*Primary Examiner*—Ren Yan
(74) *Attorney, Agent, or Firm*—Wenderoth, Lind & Ponack, L.L.P.

(57) ABSTRACT

It is proposed to provide a printing die clamp which can clamp a printing die by rotating the take-up shaft without rotating the printing cylinder. A printing die clamp is proposed for clamping a printing die 1 wrapped around an outer periphery of a printing cylinder 2 of a printing press against the outer periphery of the printing cylinder 2 by engaging one end of the printing die 1 with the printing cylinder 2 through an engaging means 18 provided on the printing cylinder 2, engaging the other end of the printing die 1 with a take-up shaft 3 rotatably mounted in a receiving groove 19 formed in the outer periphery of the printing cylinder 2, and rotating the take-up shaft 3. The printing cylinder 2 has a tubular printing cylinder shaft 9 in which a control shaft 5 is inserted so as to be rotatable relative to the printing cylinder shaft 9. The printing die clamp further includes gears 21, 22 and 23 for transmitting the rotation of the control shaft 5 to the take-up shaft 3, a die clamp motor 4 for rotating the control shaft 5, and a first clutch 6 provided in a torque transmission path through which the rotation of the die clamp motor 4 is transmitted to the control shaft 5 for selectively transmitting the rotation of the die clamp motor 4 to the control shaft 5.

2 Claims, 5 Drawing Sheets

U.S. PATENT DOCUMENTS

| | | | | | |
|---|---|---|---|---|---|
| 5,355,795 | A | | 10/1994 | Moss et al. | |
| 5,685,226 | A | * | 11/1997 | Fuller | 101/415.1 |
| 5,953,993 | A | * | 9/1999 | Yasuhara | 101/415.1 |
| 5,983,753 | A | | 11/1999 | Kostiza | |
| 6,026,747 | A | * | 2/2000 | Carme et al. | 101/415.1 |
| 6,325,322 | B1 | * | 12/2001 | Lewis | 242/538.2 |

FOREIGN PATENT DOCUMENTS

| | | |
|---|---|---|
| JP | 64-44121 | 3/1989 |
| JP | 7-101044 | 4/1995 |
| JP | 2545184 | 5/1997 |
| JP | 2000-500727 | 1/2000 |

* cited by examiner

PRINTING DIE CLAMP

TECHNICAL FIELD

This invention relates to a printing die clamp for clamping a printing die wrapped around a printing cylinder of a printing press against the outer periphery of the printing cylinder.

BACKGROUND ART

Ordinarily, a printing die of a printing press is clamped against and fixed to the outer periphery of a printing cylinder by engaging one end thereof in an engaging groove formed in the outer periphery of the printing cylinder, then fixing the other end to a take-up shaft rotatably received in a groove formed in the outer periphery of the printing cylinder, and taking up the end of the printing die to the take-up shaft by rotating the take-up shaft. The take-up shaft is rotated manually while preventing reverse rotation of the take-up shaft with a ratchet mechanism. It is troublesome to rotate it manually.

In order to eliminate such manual labor, a printing die clamp is proposed which includes a pinion mounted to one end of the take-up shaft, a gear wheel rotatably mounted to a printing cylinder shaft and meshing with the pinion, and a brake mechanism for braking the rotation of the gear wheel (Patent document 1). With this device, by rotating the printing cylinder with the gear wheel braked, the pinion rotates about the axis of the gear wheel and its own axis, so that the take-up shaft rotates.

But with this printing die clamp, in order to rotate the take-up shaft, it is necessary to rotate the printing cylinder. Thus, there is the possibility that an operator may be caught by the printing cylinder, thus causing problems concerning safety.

Patent document 1: Registered JP utility model publication 2545184

DISCLOSURE OF THE INVENTION

Object of the Invention

An object of this invention is to provide a printing die clamp which can clamp a printing die by rotating the take-up shaft without rotating the printing cylinder.

Means to Achieve the Object

In order to achieve this object, the printing cylinder has a tubular printing cylinder shaft in which a control shaft is inserted so as to be rotatable relative to the printing cylinder shaft, and the printing die clamp further comprises a torque transmission mechanism for transmitting the rotation of the control shaft to the take-up shaft, a die clamp motor for rotating the control shaft, and a first clutch provided in a torque transmission path through which the rotation of the die clamp motor is transmitted to the control shaft for selectively transmitting the rotation of the die clamp motor to the control shaft. With this printing die clamp, by transmitting the rotation of the die clamp motor to the control shaft through the first clutch, the rotation of the control shaft is transmitted to the take-up shaft through the torque transmission mechanism. Thus, the take-up shaft rotates, taking up the end of the printing die. During printing, the first clutch is disengaged to prevent the transmission of rotation of the die clamp motor to the control shaft. This prevents rotation of the control shaft relative to the printing cylinder shaft.

Preferably, the printing die clamp further comprises a second clutch for selectively joining and separating the printing cylinder shaft and the control shaft to and from each other. With this arrangement, by joining the printing cylinder shaft to the control shaft through the second clutch during printing, the printing cylinder shaft and the control shaft rotate together with each other, so that it is possible to more reliably prevent the control shaft from rotating relative to the printing cylinder shaft. While the printing die is clamped, the second clutch is disengaged to keep the printing cylinder shaft separated from the control shaft.

Further preferably, the printing die clamp further comprises a ratchet mechanism provided at one end of the take-up shaft for preventing the take-up shaft from rotating in a direction in which the printing die loosens.

ADVANTAGES OF THE INVENTION

According to the present invention, because the printing die clamp motor is provided separately from the driving source for rotating the printing cylinder, it is possible to rotate the take-up shaft without rotating the printing cylinder. Thus, the printing die can be clamped safely. By disengaging the first clutch during printing to prevent the rotation of the die clamp motor from being transmitted to the control shaft, it is possible to prevent a change in clamping force of the printing die due to rotation of the control shaft relative to the printing cylinder, so that the printing accuracy is less likely to deteriorate due to changes in elongation of the printing die.

Further, in the arrangement in which the second clutch is provided for selectively joining and separating the printing cylinder shaft and the control shaft to and from each other, by coupling the printing cylinder shaft to the control shaft through the second clutch during printing, it is possible to more reliably prevent a change in the clamping force of the printing die due to rotation of the control shaft relative to the printing cylinder shaft. Thus, it is possible to further reduce deterioration in printing accuracy due to changes in elongation of the printing die.

By providing the ratchet mechanism at one end of the take-up shaft for preventing the take-up shaft from rotating in a direction in which the printing die loosens, the printing die is less likely to loosen during printing.

DESCRIPTION OF REFERENCE NUMERALS

Figure 1:
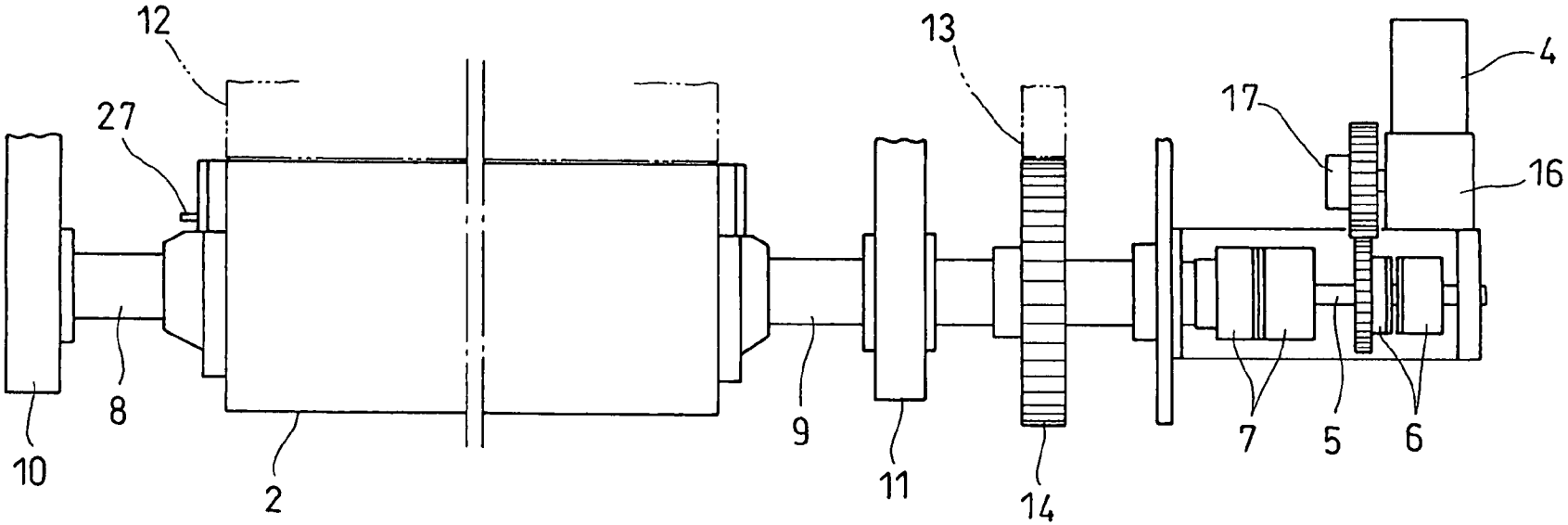
FIG. 1 is a entire view of a printing die clamp embodying the present invention.

1. Printing die
2. Printing cylinder
3. Take-up shaft
4. Die clamp motor
5. Control shaft

6. First clutch
7. Second clutch
8, 9. Printing cylinder shaft
18. Engaging groove
19. Receiving groove
21, 22, 23. Gears

BEST MODE FOR EMBODYING THE INVENTION

FIGS. 1 to 7 show the die clamp embodying the present invention. The die clamp comprises a printing cylinder 2 on which a printing die 1 is mounted, a take-up shaft 3 for taking up an end of the printing die 1, a die clamp motor 4, a control shaft 5 rotated by the die clamp motor 4, and first and second clutches 6 and 7.

As shown in FIG. 1, the printing cylinder 2 has printing cylinder shafts 8 and 9 on both sides thereof which are rotatably supported by frames 10 and 11 of the printing press, respectively. The printing cylinder shaft 9 carries a printing cylinder gear 14 fixed thereto and meshing with an impression cylinder gear 13 fixed to a shaft (not shown) of an impression cylinder 12, so that the printing cylinder 2 and the impression cylinder 12 rotate at the same speed in opposite directions.

Figure 2:
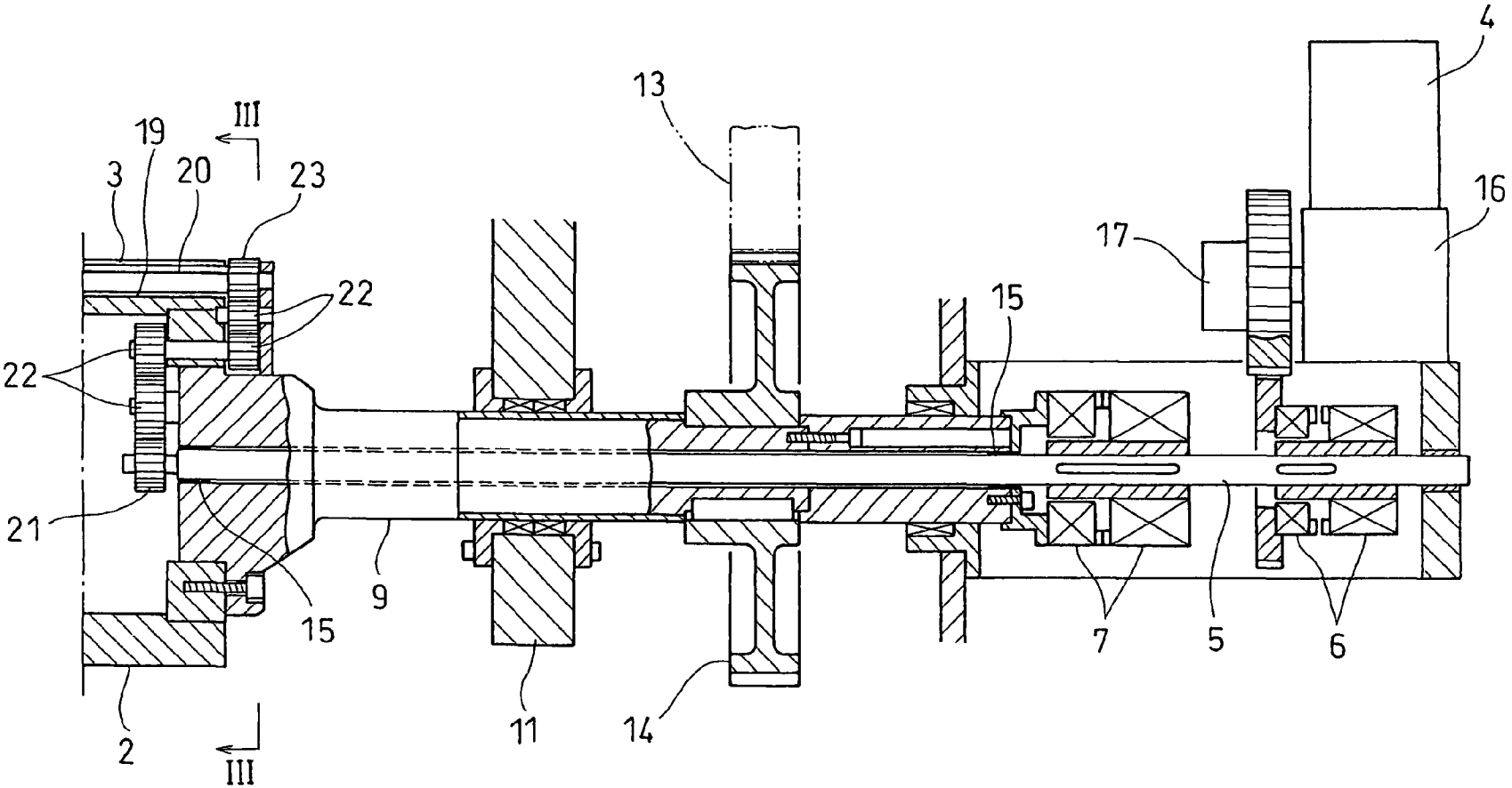
FIG. 2 is a sectional view taken along the axis of the printing cylinder shaft of the printing die clamp of FIG. 1.

As shown in FIG. 2, the printing cylinder shaft 9 is a tubular member in which the control shaft 5 is inserted. The control shaft 5 is rotatably supported by the printing cylinder shaft 9 through a bush 15 pressed into the printing cylinder shaft 9. The die clamp motor 4 is coupled to the control shaft 5 through the first clutch 6 for selectively transmitting torque. Thus, by activating the die clamp motor 4, the control shaft 5 can be rotated. The second clutch 7 is provided at the end of the printing cylinder shaft 9 to selectively couple and uncouple the printing cylinder shaft 9 to and from the control shaft 5.

A speed reducer 16 is mounted to the die clamp motor 4 to reduce and transmit the rotation of the die clamp motor 4. The speed reducer 16 includes a torque limiter 17 that serves to stop transmission of rotation if the resistance to rotation of the control shaft 5 increases excessively, thereby preventing damage to the control shaft 5.

Figure 5:
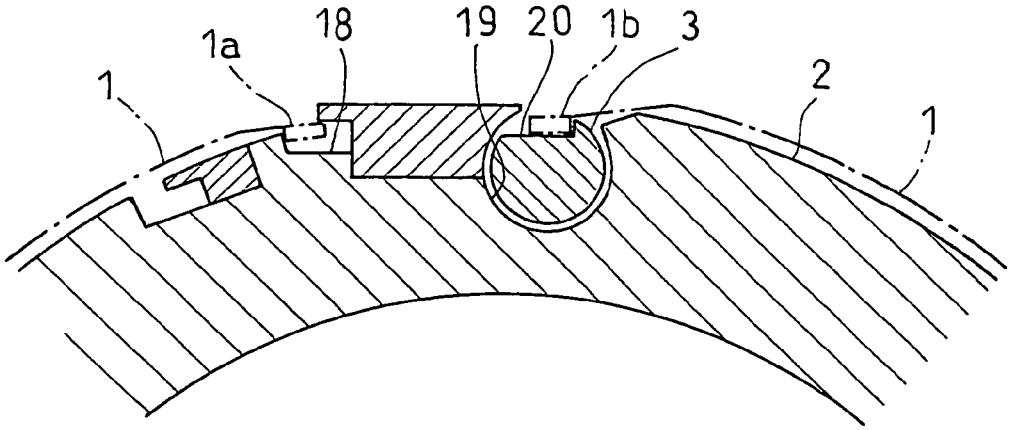
FIG. 5 shows the state in which the printing die has one end thereof held by the take-up shaft of the printing die clamp.

As shown in FIG. 5, an axial continuous engaging groove 18 is formed in the outer periphery of the printing cylinder 2. The printing die 1 has an engaging piece 1*a* at one end thereof which can engage in the engaging groove 18. A receiving groove 19 is formed in the printing cylinder 2 at its position circumferentially spaced from the engaging groove 18. The take-up shaft 3 is rotatably mounted in the receiving groove 19. The take-up shaft 3 has a cutout 20 in the outer periphery thereof that continuously extends in the axial direction thereof. By engaging an engaging piece 1*b* provided at the other end of the printing die 1 in the cutout 20, the other end of the printing die 1 is held in position.

Figure 3:
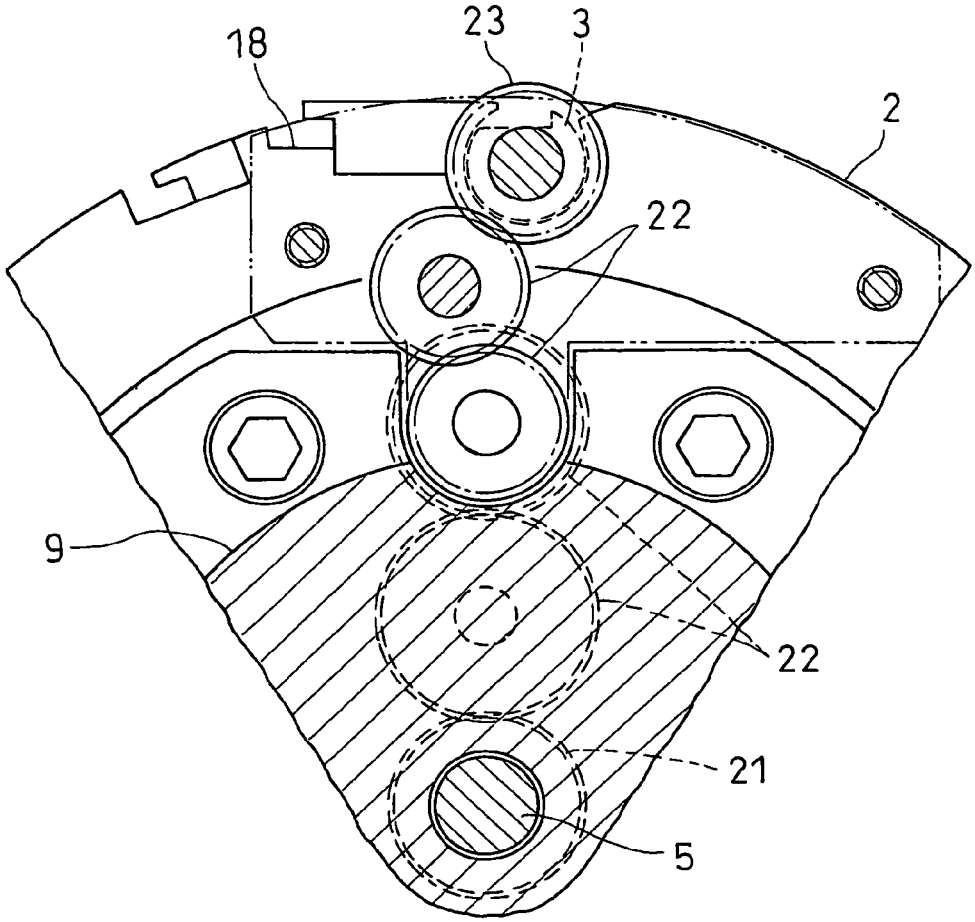
FIG. 3 is a sectional view taken along line III-III of FIG. 2.

As shown in FIG. 2, the control shaft 5 extends through the printing cylinder shaft 9 and carries at its portion protruding from the shaft 9 a gear 21 that meshes, as shown in FIG. 3, with a gear 23 fixed to the end of the take-up shaft 3 through gears 22 rotatably mounted to the printing cylinder 2. Thus, when the control shaft 5 is rotated, its rotation is transmitted to the take-up shaft 3 through the gears 21, 22 and 23.

Figure 4:
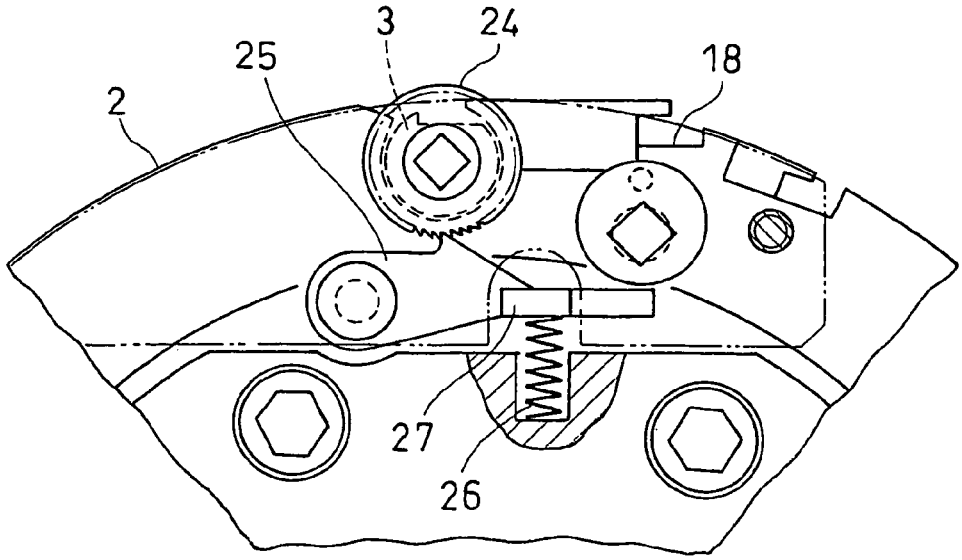
FIG. 4 shows the ratchet mechanism of the printing die clamp of FIG. 1.

As shown in FIG. 4, a ratchet wheel 24 is mounted to the take-up shaft 3 at its end opposite to its end to which the gear 23 is mounted. A ratchet 25 that is pivotally mounted to the printing cylinder 2 is in engagement with the ratchet wheel 24 so that the take-up shaft 3 is rotatable only in one direction in which the printing die 1 is clamped against the printing cylinder. The ratchet 25 is kept in engagement with the ratchet wheel 24 by a spring 26 that biases the ratchet 25 toward the ratchet wheel 24. The ratchet 25 is formed with a lever 27 for disengaging the ratchet 25 from the ratchet wheel 24. By operating the lever 27, the ratchet 25 can be pivoted in the direction in which the ratchet 25 disengages from the ratchet wheel 24.

Using this die clamp, the printing die 1 can be clamped against the outer periphery of the printing cylinder 2 in e.g. the following manner.

Figure 6:
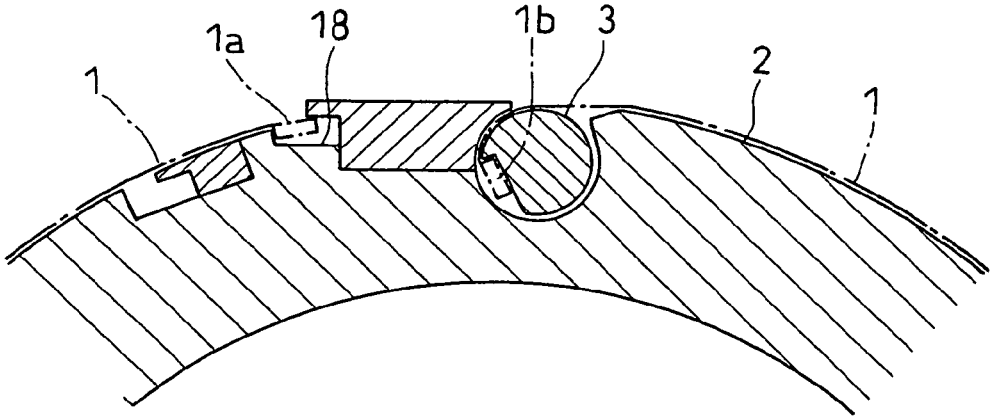
FIG. 6 shows the state in which the printing die has been clamped by rotating the take-up shaft.
Figure 7:
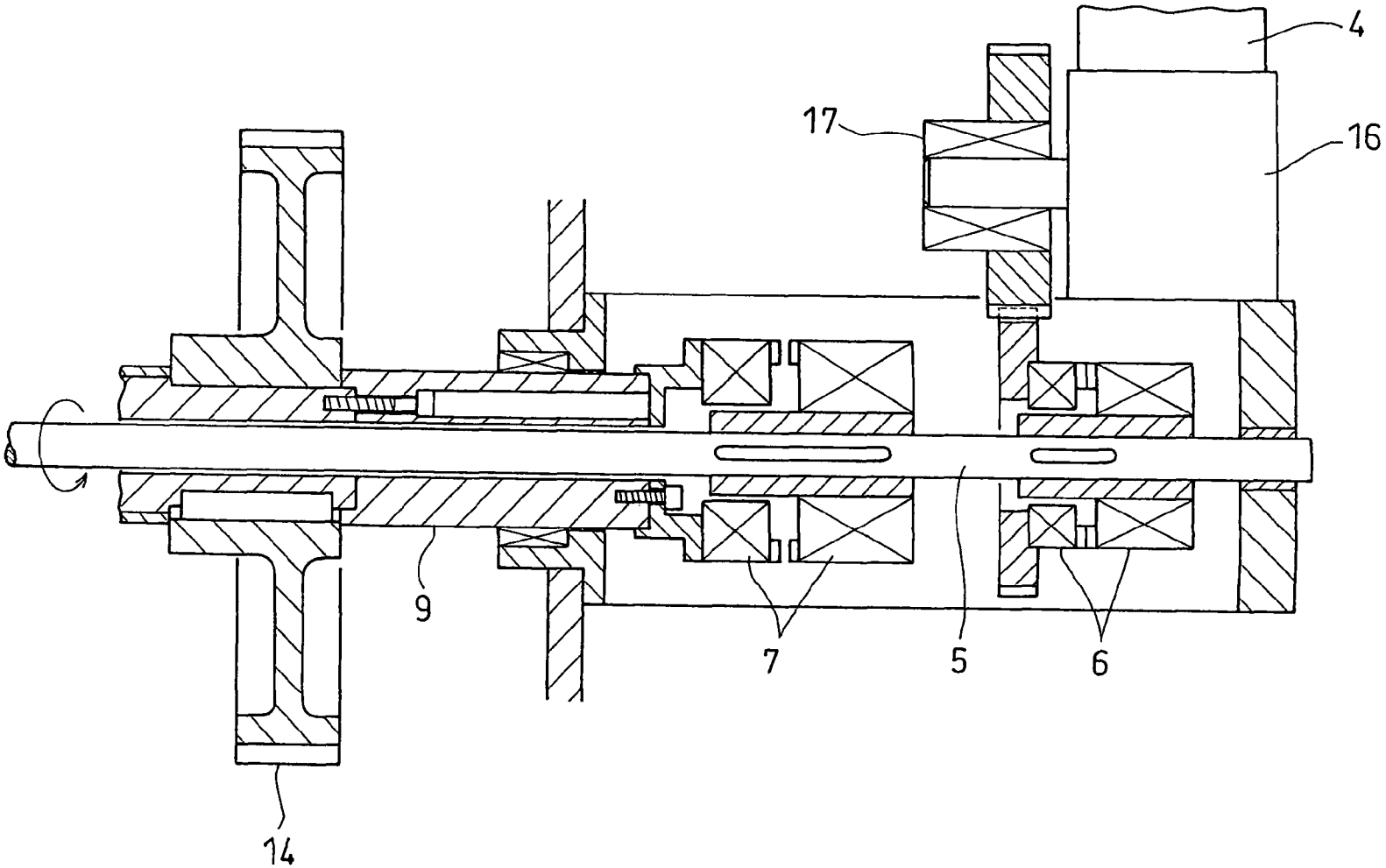
FIG. 7 shows the state in which the first clutch of FIG. 2 is engaged and the second clutch is disengaged.

First as shown in FIG. 5, the printing die 1 is wrapped around the printing cylinder 2, the engaging piece 1*a* at one end of the printing die 1 is engaged in the engaging groove 18 of the printing cylinder 2, and the engaging piece 1*b* at the other end of the printing die 1 is engaged in the cutout 20 of the take-up shaft 3. Then, as shown in FIG. 7, the first clutch 6 is engaged so that the rotation of the die clamp motor 4 can be transmitted to the control shaft 5. Simultaneously, the second clutch 7 is disengaged to separate the printing cylinder shaft 9 from the control shaft 5. In this state, the die clamp motor 4 is activated to rotate the control shaft 5. When the control shaft 5 rotates, the take-up shaft 3 rotates to take up the end of the printing die 1 as shown in FIG. 6, thereby clamping the printing die 1 against the outer periphery of the printing cylinder 2.

Once the printing die 1 is clamped against the outer periphery of the printing cylinder 2, as shown in FIG. 2, the first clutch 6 is disengaged to stop transmission of rotation from the die clamp motor 4 to the control shaft 5, while the printing cylinder shaft 9 is coupled to the control shaft 5 through the second clutch 7 to perform printing. In this state, because the first clutch 6 prevents transmission of the rotation of the die clamp motor 4 to the control shaft 5, the control shaft 5 is less likely to rotate relative to the printing cylinder shaft 9. Thus, the force with which the printing die 1 is clamped against the printing cylinder is less variable, so that the printing accuracy is less likely to deteriorate due to changes in elongation of the printing die 1. Also, because the printing cylinder shaft 9 is coupled to the control shaft 5 through the second clutch 7, the second clutch 7 allows the printing cylinder shaft 9 and the control shaft 5 to rotate together, thus further reducing the possibility of rotation of the printing cylinder shaft 9 relative to the control shaft 5. This further improves the printing accuracy. Further, by engaging the ratchet wheel 24, the ratchet 25 prevents the take-up shaft 3 from rotating in the direction in which the printing die 1 loosens. This prevents loosening of the printing die 1.

To dismount the printing die 1 from the printing cylinder 2, after stopping the rotation of the printing cylinder 2, as shown in FIG. 7, the first clutch 6 is engaged so that the rotation of the die clamp motor 4 can be transmitted to the control shaft 5, and the second clutch 7 is disengaged to separate the printing cylinder shaft 9 from the control shaft 5. Further, the ratchet 25 is disengaged from the ratchet wheel 24. In this state, the die clamp motor 4 is reversed to rotate the take-up shaft 3, thereby loosening the printing die 1.

In this die clamp, since the take-up shaft 3 is rotated by the die clamp motor 4, it is less troublesome to clamp the printing die. Since the take-up shaft 3 can be rotated without rotating the printing cylinder 2, the printing die can be clamped safely.

The printing die 1 may be manually loosened and dismounted with the first clutch 6 disengaged, thereby preventing the rotation of the die clamp motor 4 from being transmitted to the control shaft 5, with the printing cylinder shaft 9 separated from the control shaft 5 by means of the second clutch 7, and with the ratchet 25 disengaged from the ratchet wheel 24.

What is claimed is:

1. A printing die clamp for clamping a printing die 1 wrapped around an outer periphery of a printing cylinder 2 of a printing press against the outer periphery of the printing cylinder 2 by engaging one end of the printing die 1 with the printing cylinder 2 through an engaging means 18 provided on the printing cylinder 2, engaging the other end of the printing die 1 with a take-up shaft 3 rotatably mounted in a receiving groove 19 formed in the outer periphery of the printing cylinder 2, and rotating the take-up shaft 3, characterized in that the printing cylinder 2 has a tubular printing cylinder shaft 9 in which a control shaft 5 is inserted so as to be coaxial with and rotatable relative to the printing cylinder shaft 9, and the printing die clamp further comprises a torque transmission mechanism 21, 22 and 23 for transmitting the rotation of the control shaft 5 to the take-up shaft 3, a die clamp motor 4 for rotating the control shaft 5, a first clutch 6 provided in a torque transmission path through which the rotation of the die clamp motor 4 is transmitted to the control shaft 5 for selectively transmitting the rotation of the die clamp motor 4 to the control shaft 5, and a second clutch 7 for selectively joining and separating the printing cylinder shaft 9 and the control shaft 5 to and from each other.

2. The printing die clamp of claim 1 further comprising a ratchet mechanism provided at one end of the take-up shaft 3 for preventing the take-up shaft 3 from rotating in a direction in which the printing die 1 loosens.

* * * * *